US006464118B2

(12) United States Patent
McUmber

(10) Patent No.: US 6,464,118 B2
(45) Date of Patent: Oct. 15, 2002

(54) BACK-SUPPORTED LOAD-CARRYING MECHANISM WITH PIVOTING LUMBAR SUPPORT

(75) Inventor: Andrew McUmber, Garland, TX (US)

(73) Assignee: Azora, L.L.C., Dallas, TX (US)

( * ) Notice: Subject to any disclaimer, the term of this patent is extended or adjusted under 35 U.S.C. 154(b) by 0 days.

(21) Appl. No.: 09/774,318

(22) Filed: Jan. 31, 2001

(65) Prior Publication Data

US 2002/0100778 A1 Aug. 1, 2002

(51) Int. Cl.[7] ..... A45F 4/00

(52) U.S. Cl. ..... 224/155; 224/634; 224/270; 297/16.1

(58) Field of Search ..... 224/155, 634, 224/270; 297/16.1

(56) References Cited

U.S. PATENT DOCUMENTS

| | | | | | |
|---|---|---|---|---|---|
| 2,712,404 | A | * | 7/1955 | Miller | 224/181 |
| 3,292,830 | A | * | 12/1966 | Mack | 16/371 |
| 4,450,990 | A | * | 5/1984 | Bolstad | 224/155 |
| 4,489,866 | A | * | 12/1984 | Korte | 224/155 |
| 4,720,029 | A | * | 1/1988 | Varanakis | 224/153 |
| 4,836,938 | A | * | 6/1989 | Kobasic | 224/153 |
| D306,379 | S | | 3/1990 | Kobasic | D6/367 |
| 5,087,095 | A | * | 2/1992 | McFate | 224/155 |
| 5,131,575 | A | * | 7/1992 | Charest | 224/155 |
| 5,139,308 | A | * | 8/1992 | Ziman | 224/155 |
| 5,303,975 | A | * | 4/1994 | Asato | 224/155 |
| 5,381,941 | A | | 1/1995 | Brune | 224/155 |
| 5,409,291 | A | | 4/1995 | Lamb et al. | 297/129 |
| 5,527,089 | A | * | 6/1996 | Charest | 224/155 |
| 5,533,654 | A | * | 7/1996 | Holty et al. | 224/155 |
| 5,536,064 | A | * | 7/1996 | MacLean | 224/155 |
| 5,538,318 | A | * | 7/1996 | MacLean | 224/155 |
| 5,547,246 | A | * | 8/1996 | Lambert | 224/153 |
| 5,597,101 | A | * | 1/1997 | Barber et al. | 224/153 |
| 5,695,099 | A | * | 12/1997 | Strum | 224/155 |
| 5,868,462 | A | * | 2/1999 | Truax | 224/155 |
| 5,950,895 | A | | 9/1999 | Zakarin | 224/645 |
| 5,975,389 | A | * | 11/1999 | Braun et al. | 182/187 |
| 6,095,599 | A | * | 8/2000 | Lambert | 224/155 |

FOREIGN PATENT DOCUMENTS

| | | | | |
|---|---|---|---|---|
| GB | 2278271 | A * | 11/1994 | 224/155 |
| WO | WO 98/38891 | | 9/1998 | |

* cited by examiner

*Primary Examiner*—Stephen P. Garbe
(74) *Attorney, Agent, or Firm*—Steven W. Smith

(57) ABSTRACT

A back-supported load-carrying mechanism that includes a molded frame having a lumbar support element pivotally connected to a lower portion of the frame. The lumbar support element extends vertically, approximately halfway up the back of a user and horizontally, the full width of the frame, thus providing a large area of surface contact with the user's back. On the surface that contacts the user's back, the lumbar support element is anthropometrically shaped to fit the user's back. This surface is also covered by a non-sliding foam inlay. The lumbar support element may pivot approximately 95 degrees downwards, with the rear side of the lumbar support element providing a seat for the user. A load-support piece may be connected to the rear of the frame to provide a support shelf for the load being carried and to provide rear support when the back-supported load-carrying mechanism is in a chair configuration.

12 Claims, 5 Drawing Sheets

BACK-SUPPORTED LOAD-CARRYING MECHANISM WITH PIVOTING LUMBAR SUPPORT

BACKGROUND OF THE INVENTION

1. Technical Field of the Invention

The present invention relates to a back-supported load-carrying mechanism and, in particular, to a back-supported load-carrying mechanism that includes a pivoting lumbar support element.

2. Description of Related Art

The use of backpack devices (backpacks and backpack frames used for carrying loads) is known in the prior art. Existing embodiments have utilized a single horizontal bar, a padded horizontal bar, a narrow strap, or molded pads to provide support for the backpack device in the lumbar region of the user's back. However, there are problems with the comfort and functionality of these existing lumbar supports. Due to the shortcomings of existing lumbar supports, backpack devices often slide down from the weight of the load being carried and tend to shift off center providing uneven weight distribution on the shoulders and back of the user. Further, existing lumbar supports do not conform to the backs of the wide variety of individuals wearing the backpack device.

It would be advantageous to have a back-supported load-carrying mechanism that overcomes the shortcomings of existing backpack devices. The present invention provides such a mechanism.

SUMMARY OF THE INVENTION

Accordingly, it is an object of the present invention to provide a new and improved back-supported load-carrying mechanism which includes a pivotally mounted lumbar support element to allow for an even distribution of cargo weight to the lower back of a user, thus eliminating stress to the neck and upper back areas of the user.

An even further object of the present invention is to provide a back-supported load-carrying mechanism having a rigid frame anthropometrically curved to fit a user's back, covered with a non-sliding foam inlay. The frame has a first and second vertical extension on each side. A lumbar support element is also anthropometrically curved to fit the user's back, and is covered with non-sliding foam inlay. The lumbar support element is pivotally mounted on a horizontal axle connected to the first and second vertical extensions of the frame. The lumbar support element extends vertically, approximately halfway up the frame. A load support piece may be mounted on the back side of the vertical frame extensions.

Still another object of the present invention is to provide a back-supported load-carrying mechanism that has a load support piece functioning as a rear support, with vertical frame extensions functioning as the front legs of a chair when the lumbar support element is rotated forward and downward approximately 95 degrees.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described preferred embodiments of the invention.

BRIEF DESCRIPTION OF THE DRAWINGS

The invention will be better understood and its numerous objects and advantages will become more apparent to those skilled in the art by reference to the following drawings, in conjunction with the accompanying specification, in which.

DETAILED DESCRIPTION OF EMBODIMENTS

The above-described figures illustrate the preferred embodiment of the present invention, a back-supported load-carrying mechanism 10 with a pivoting lumbar support element 18. The pivoting lumbar support element provides the mechanism with consistent weight distribution even when the user is performing physical activities involving bending at the waist and leaning from side-to-side because the lumbar support element pivots proportionately with the users varying body position. The mechanism effectively shifts the weight of the load from the user's shoulders to a broad area of the user's lower back.

Figure 1:
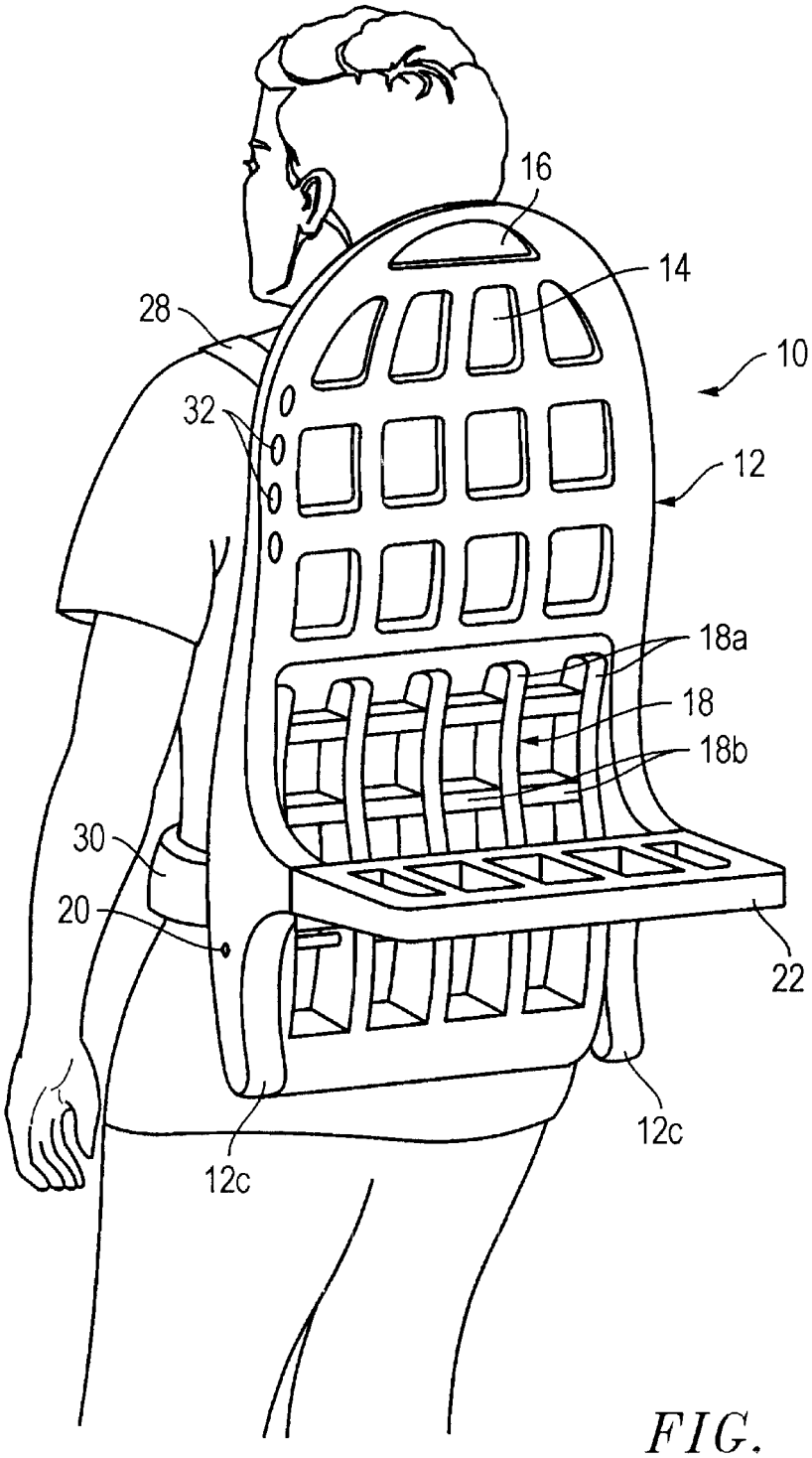
FIG. 1 is a rear perspective view of the preferred embodiment of the present invention in its folded configuration.

FIG. 1 is a rear perspective view of the preferred embodiment of the present invention in its folded configuration. The back-supported load-carrying mechanism 10 includes a molded frame 12. The front side of the frame (the side resting against the user's back) is designed to mimic the curvature of the spine. The front side of the frame has a region of convex curvature 12*a* (see FIG. 2) throughout the thoracic, lumbar, and upper sacrum areas of the back. The frame transitions to a region of concave curvature 12*b* just above the thoracic region towards the upper back, and neck areas.

The frame 12 has a raised lip edge around all the forward facing surfaces for accepting, containing, and/or protecting the edges of a polyolefin foam inlay. This foam is applied to all surfaces of the back-supported load-carrying mechanism which come in direct contact with the user's body. This includes the molded back-support portion of the frame, the rear and front surfaces of the lumbar support element 18 and both integrated vertical frame extensions 12*c*. In the preferred embodiment, the foam inlay is a closed-cell cross-linked polyofin foam product. Actual foam density, type and color may vary depending on the specific use application or style. This is a lightweight water-resistant product that provides comfort and cushion to any body parts with which it comes in contact.

The frame has a plurality of large openings 14 molded in the upper back, shoulder and neck regions to decrease weight and provide ventilation. An elliptical-shaped opening 16 at the top of the frame 12 provides a handle for carrying the back-supported load-carrying mechanism when it is not being worn. Several holes 32 running from the front to the back of the frame act as tie down points to secure the load being carried and to provide for additional items to be affixed or temporarily tied to the mechanism. Two frame extensions 12*c* extend downward to form the base of the frame on each side.

A load-support piece 22 may be connected to the frame extensions 12*c* to provide a support shelf for the load being carried and to transfer the weight of the load to the lower lumbar and upper hip regions rather than to the neck and shoulder areas of the user. The load-support piece is interchangeable, and different load-support pieces are designed to hold varying selected items such as camping gear, drink coolers, scuba tanks, and other specific use items. A male extension 24 on each side of the load support piece slides into and interlocks with a female connector 26 such as a four-sided open channel (see FIG. 2) formed in the rear side of each frame extension 12*c*.

Figure 5:
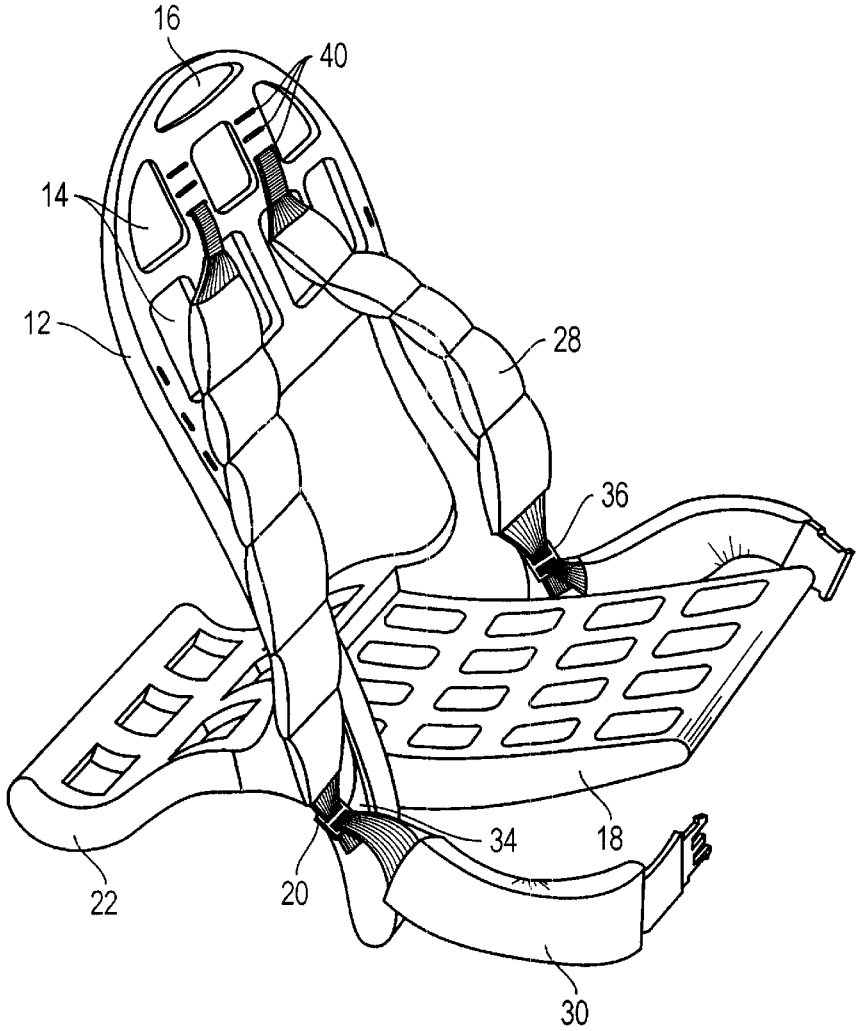
FIG. 5 is a front perspective view of the preferred embodiment of the present invention in its unfolded configuration.

An ergonomically designed lumbar support element 18 is pivotally mounted in the lower portion of the frame 12 between the frame extensions 12*c*. The lumbar support element may be constructed as a plurality of vertically oriented sub-elements 18*a* connected by horizontal cross pieces 18*b*. The sub-elements extend vertically, approximately halfway up the back of the user. The lumbar support element extends horizontally the full width of the frame, thus providing a large area of surface contact with the user's back. The lumbar support element can also be constructed with an open grid design as shown in FIG. 5.

The lumbar support element 18 pivots around a horizontal axle 20, mounted to each of the frame extensions 12*c* approximately ¼ to ⅓ of the way up the lumbar support element. The axle is a rod made from metal or another suitable rigid material, that runs horizontally through the entire lumbar support element 18, and is mounted in the frame extensions. The back-supported load-carrying mechanism may be attached to the user's body by the use of shoulder straps 28 and a waist strap 30.

The frame and lumbar support element may be constructed of any suitable lightweight, rigid material such as wood, plastic, aluminum, and so on. In the preferred embodiment, the frame and lumbar support element are constructed from an injection-molded or compression-molded plastic/graphite composite. In general, graphite composites provide the best strength-to-weight ratio, but are more expensive than other materials available, such as polycarbonates, nylon and fiberglass. Poly-carbonate plastics provide sufficient strength at a lower cost, but may be heavier than graphite composites. Suitable materials may also be formed from metals such as tungsten or copper/carbon/aluminum composites.

Figure 2:
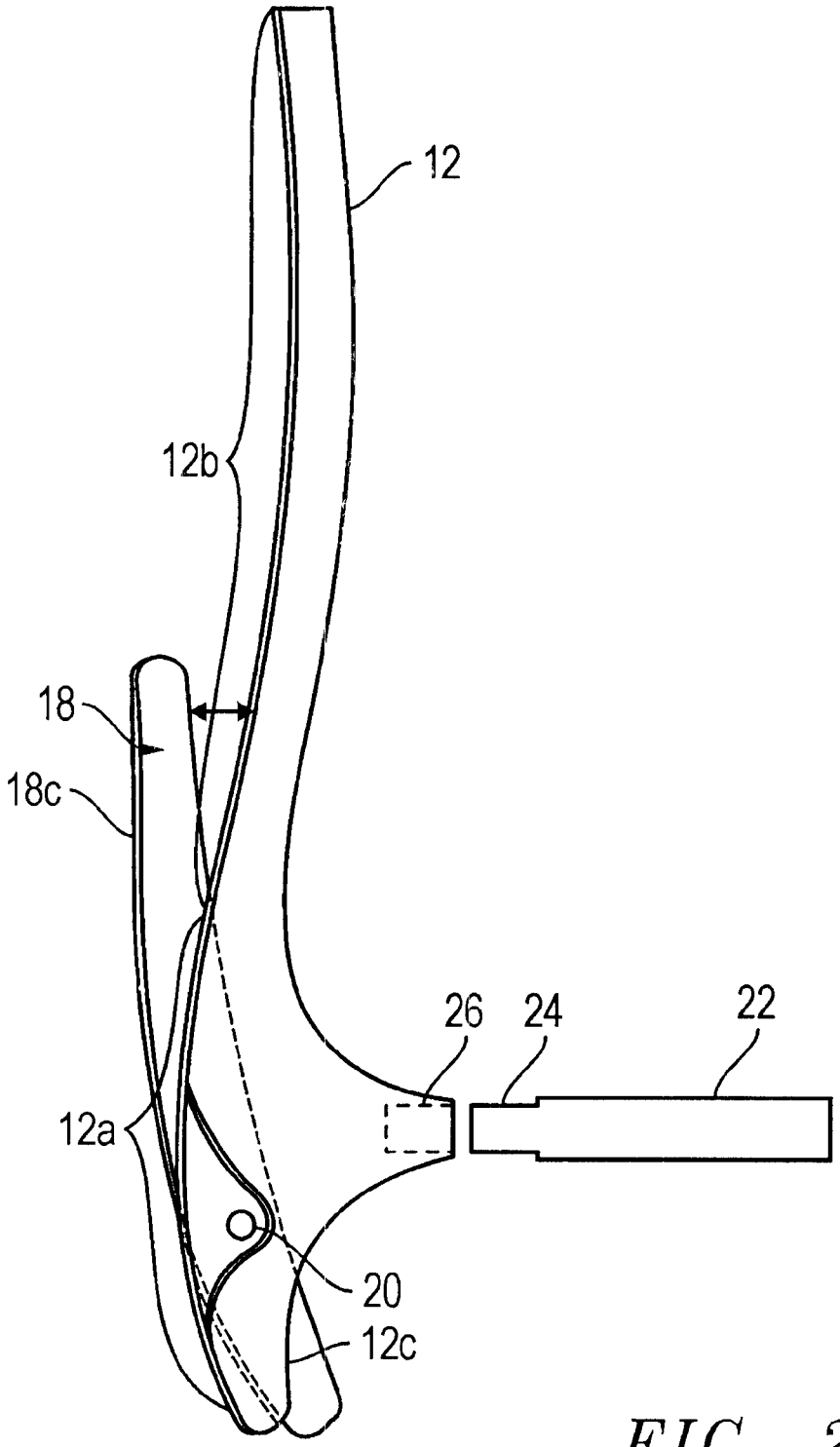
FIG. 2 is a side elevational view of the preferred embodiment of the present invention with the lumbar support element pivoting forward and downward.

FIG. 2 is a side elevational view of the preferred embodiment of the present invention with the lumbar support element 18 pivoting forward and downward. When the back-supported load-carrying mechanism is worn on the back, the pivoting lumbar support element 18 changes its angle to correlate with the user's body positions, thereby distributing the weight of the load consistently to the hips and upper sacrum region of the user which eliminates stress to the neck and upper back areas of the user. The total pivoting range of the lumbar support element is approximately 105 degrees, 95 degrees in the forward direction and 10 degrees in the rearward direction. The surface of the lumbar support element that contacts the user's back is curved to provide an anthropometrically correct curvature, matching the curvature of the user's back. The front surface is also covered by the non-sliding foam inlay 18*c*. Thus, the pivoting of the lumbar support element, the curvature of its surface, the large area of surface contact between the lumbar support element and the user's back, and the non-sliding foam inlay utilized on the lumbar support element prevent the pack from sliding down the user's back or slipping from side to side during use.

Figure 3:
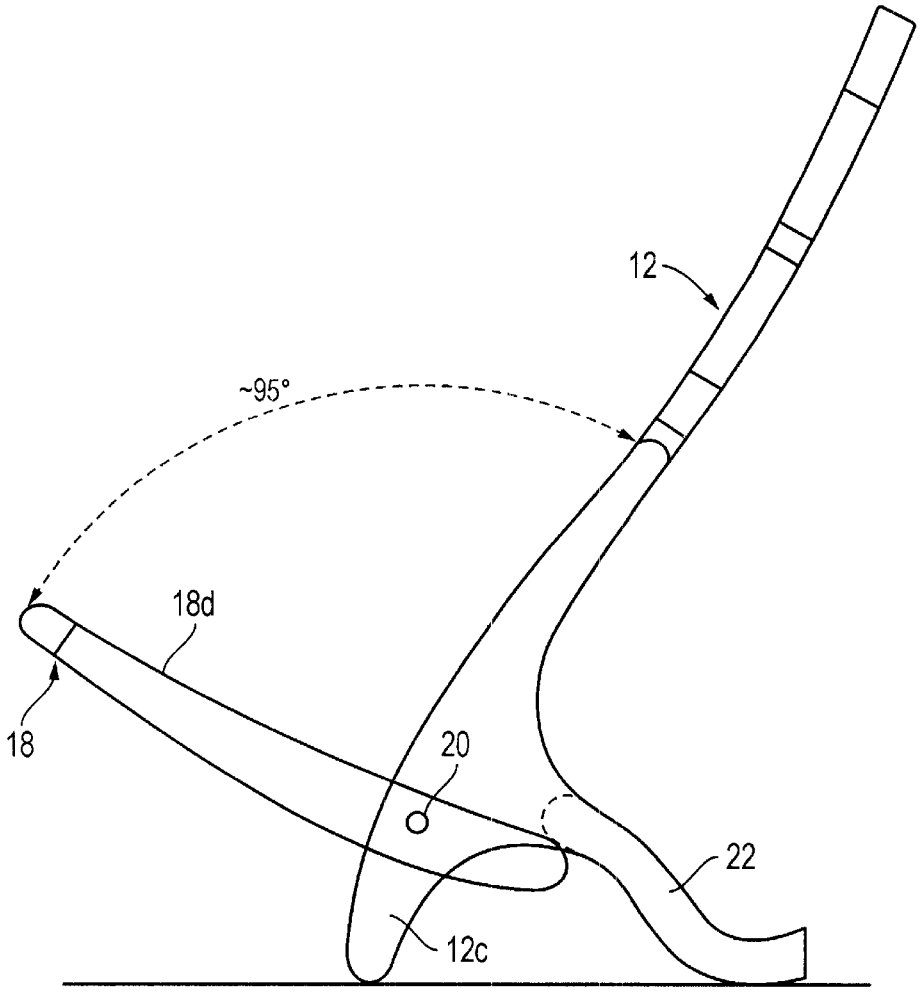
FIG. 3 is a side elevational view of the preferred embodiment of the present invention with the lumbar support element in a fully downward position to form a seat.

FIG. 3 is a side elevation view of the preferred embodiment of the present invention with the lumbar support element 18 in a fully downward position to form a seat. The lumbar support element can be converted into a seat by pivoting the lumbar support element 18 approximately 95 degrees downwards. Rotation of the lumbar support element is stopped at approximately 95 degrees when the lower end of the lumbar support element pivots rearward and upward, and contacts the lower surface of the load support piece 22. The reverse side of the pivoting lumbar support piece then provides a seat for the user which is concavely curved and covered in a foam inlay 18*d*.

The frame extensions 12*c* function as the front two legs of a chair when the lumbar support element 18 is pivoted to the seat position. The load support piece 22 functions as a rear support for the chair. The inclination of the back of the chair is thus determined by the length and curvature of the interchangeable load-support piece 22.

Figure 4A:
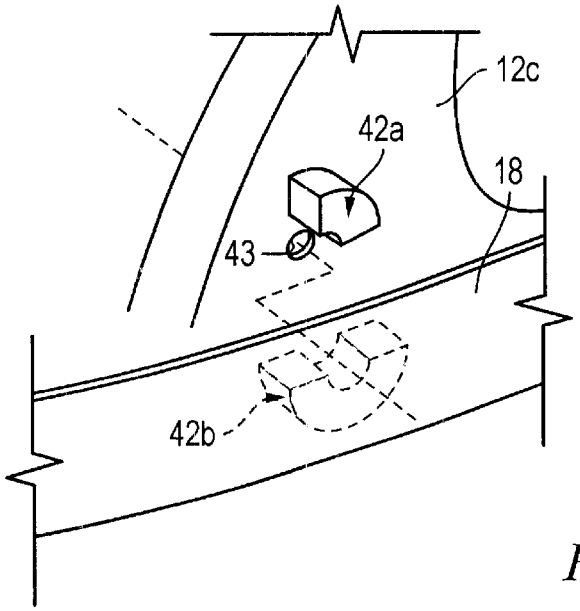
FIG. 4A is a partial exploded perspective view of an optional stopping mechanism for the lumbar support element.

FIG. 4A is a partial exploded perspective view of an optional stopping mechanism 42 for the lumbar support element. A raised protrusion piece 42*a* is stationary and molded into the inside facing walls of each of the frame extensions 12*c*. A corresponding stop piece 42*b* is molded on either side of the lumbar support element, and rotates therewith. Both pieces surround a hole 43 through which the fixed axle is inserted.

Figure 4B:
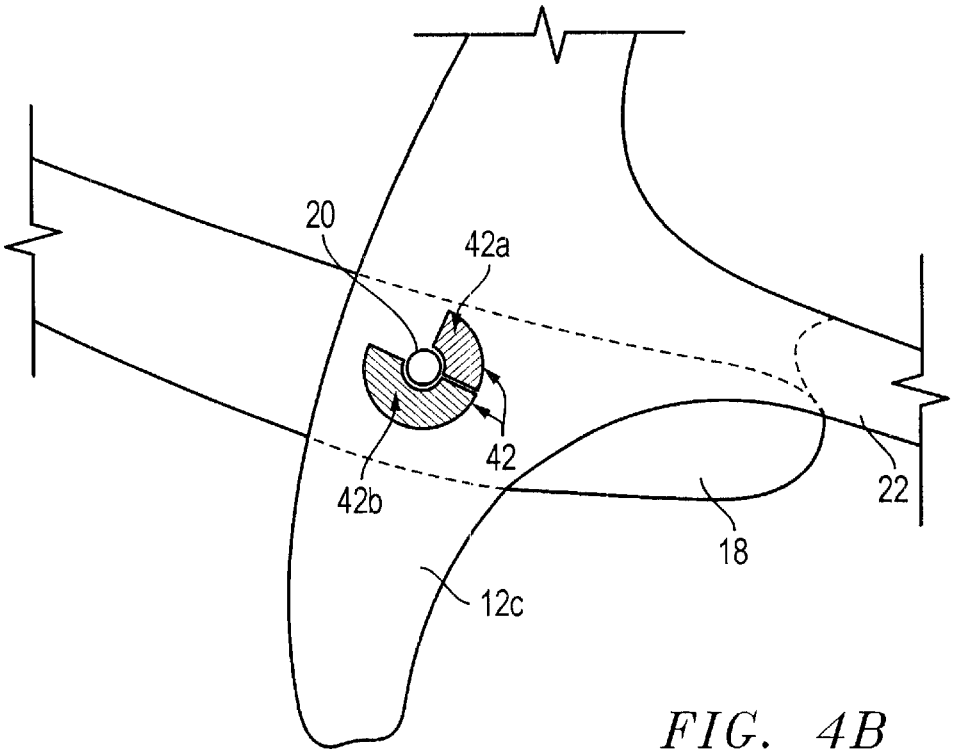
FIG. 4B is a partial side elevational view of the optional stopping mechanism of FIG. 4A when the pivoting lumbar support element is in the fully downward position.

FIG. 4B is a partial side elevational view of the optional stopping mechanism of FIG. 4A when the pivoting lumbar support element is in the fully downward position. Stoppage of the lumbar support element 18 occurs when the lumbar support stop piece 42*b* contacts the raised protrusion piece 42*a* on the frame extension. When the lumbar support element 18 is pivoted to the fully upward position, the other end of the stop piece 42*b* contacts the other end of the raised protrusion piece 42*a*, thereby stopping the lumbar support element.

FIG. 5 is a front perspective view of the preferred embodiment of the present invention in its unfolded configuration. A series of paired parallel slots 40 are cut through the back frame where the top ends of the shoulder straps 28 are inserted through and affixed to the frame. Each pair of slots allows the back-supported load-carrying mechanism to be placed at a different height in order to fit the user. The waist strap 30 is inserted through a slot 34 located on the front face of each vertical extension and exits through a slot located on the outer side of each vertical extension 36. These slots are located just above the axle 20. A buckle located on the other end of the waist strap allows the strap to be affixed around the user.

Once the back-supported load-carrying mechanism is unfolded, the user is provided with an off the ground, convenient chair since no fasteners, latches, screws, or tools are required to make this transformation possible. Conversion does not require any of the gear or load supported on the molded frame to be removed.

In an alternative embodiment, the load support piece can be eliminated, and a container such as a canvas bag may be attached to the frame for carrying articles such as books. This configuration more easily fits into school lockers, or is more easily carried on a school bus when the back-supported load-carrying mechanism is used as a book bag holder. The same benefits are provided by the pivoting lumbar support 18, preventing slippage of the book bag, and placing an even distribution of the weight on the user's hips and lower back areas. This is important for young children carrying a heavy load of books to school. This configuration also allows for larger items that may extend below the user's waist (such as a kayak) to be carried.

It is to be understood that even though numerous characteristics and advantages of the present invention have been set forth in the foregoing description, the disclosure is illustrative only, and changes may be made in detail, especially in matters of size, shape and arrangement of parts within the principles of the invention to the full extent indicated by the broad general meaning of the terms in which the appended claims are expressed.

What is claimed is:

1. A back-supported load-carrying mechanism comprising:

a rigid frame having an upper portion and a lower portion having an opening therein, said lower portion including:

a first vertical frame extension on a first side of the frame; and a second vertical frame extension on a second side of the frame; and a lumbar support element having a front surface with a non-sliding foam inlay that contacts a user's back, said lumbar support being anthropometrically shaped to fit the user's back, and being pivotally mounted in the opening in the lower portion of the frame on a horizontal shaft connected to the first and second vertical frame extensions, said lumbar support element extending horizontally from the first vertical frame extension to the second vertical frame extension, and extending vertically approximately halfway up the frame.

2. A back-supported load-carrying mechanism comprising:

a rigid frame having an upper portion and a lower portion, said lower portion including a first vertical frame extension on a first side of the frame and a second vertical frame extension on a second side of the frame, said first and second vertical frame extensions forming an opening in the lower portion of the frame;

a lumbar support element pivotally mounted on a horizontal shaft connected to the first and second vertical frame extensions in the opening in the lower portion; and a load support piece removably mounted on a back side of the lower portion of the frame.

3. The back-supported load-carrying mechanism of claim 2 further comprising a plurality of interchangeable load support pieces individually mountable on the lower portion of the frame, each of said interchangeable load support pieces having a configuration that is designed for supporting a different type of load.

4. A back-supported load-carrying mechanism comprising:

a rigid frame having an upper portion and a lower portion having an opening therein, said lower portion including:

a first vertical frame extension on a first side of the frame; and a second vertical frame extension on a second side of the frame;

a lumbar support element pivotally mounted in the opening in the lower portion on a horizontal shaft connected to the first and second vertical frame extensions; and a load support piece mounted on a back side of the lower portion of the frame, said load support piece having a right side and a left side, and including two horizontally oriented male extensions that extend forward from the right and left sides and interlock with a female channel in each of the vertical frame extensions.

5. A back-supported load-carrying mechanism comprising:

a rigid frame having an upper portion and a lower portion having an opening therein, said lower portion including:

a first vertical frame extension on a first side of the frame; and a second vertical frame extension on a second side of the frame;

a lumbar support element pivotally mounted in the opening in the lower portion on a horizontal shaft connected to the first and second vertical frame extensions; and a load support piece having a lower surface, said load support piece being mounted on a back side of the lower portion of the frame in a position in which rotation of the lumbar support element is stopped when a lower end of the lumbar support element contacts the lower surface of the load support piece.

6. The back-supported load-carrying mechanism of claim 5 wherein the load support piece is mounted in a position that allows the lumbar support element to rotate approximately 95 degrees.

7. The back-supported load-carrying mechanism of claim 6 wherein the load support piece functions as a rear support, and the first and second frame extensions function as front legs of a chair when the lumbar support element is rotated approximately 95 degrees.

8. A back-supported load-carrying mechanism comprising:

a rigid frame having a front surface with a non-sliding foam inlay that contacts a user's back, said front surface being anthropometrically curved to fit the user's back, said frame including an upper portion and a lower portion having an opening therein; and a lumbar support element pivotally mounted in the opening in the lower portion.

9. A back-supported load-carrying mechanism comprising:

a rigid frame anthropometrically curved to fit a user's back and covered with a non-sliding padding, said frame having an upper portion and a lower portion, said lower portion comprising:

a first vertical frame extension on a first side of the frame; and a second vertical frame extension on a second side of the frame;

a lumbar support element anthropometrically curved to fit the user's back and covered with the non-sliding padding, said lumbar support element being pivotally mounted on a horizontal axis connected to the first and second vertical frame extensions, said lumbar support element extending horizontally from the first vertical frame extension to the second vertical frame extension, and extending vertically approximately halfway up the frame; and a load support piece mounted on a back side of the first and second vertical frame extensions.

10. The back-supported load-carrying mechanism of claim 9 wherein the load support piece includes a lower surface, and the load support piece is mounted in a position in which rotation of the lumbar support element is stopped at approximately 95 degrees when a lower end of the lumbar support element contacts the lower surface of the load support piece.

11. The back-supported load-carrying mechanism of claim 10 wherein the load support piece functions as a rear support, and the first and second frame extensions function as front legs of a chair when the lumbar support element is rotated approximately 95 degrees.

12. A back-supported load-carrying mechanism comprising:

a rigid frame having an upper portion and a lower portion, said lower portion including a first vertical frame extension on a first side of the frame and a second vertical frame extension on a second side of the frame, said first and second vertical frame extensions forming an opening in the lower portion of the frame;

a horizontal shaft connected to the first and second vertical frame extensions in the opening in the lower portion; and a lumbar support element having a top edge and a bottom edge, and a front surface that contacts a user's back and is shaped to anthropometrically fit the user's back, said bottom edge being approximately aligned with a bottom end of the vertical frame extensions, and the top edge being approximately halfway up the frame, said lumbar support element being pivotally mounted on the horizontal shaft that is mounted through the lumbar support approximately ¼ to ⅓ of the way from the bottom edge to the top edge, thereby allowing the lumbar support element to pivot in both a forward direction and a rearward direction.

* * * * *